US007547651B2

(12) United States Patent
Wilson

(10) Patent No.: US 7,547,651 B2
(45) Date of Patent: Jun. 16, 2009

(54) METAL CLADDING COMPOSITION

(75) Inventor: Gary Wilson, Portland, OR (US)

(73) Assignee: Applied Technology Laboratories LLC, Vancouver, WA (US)

( * ) Notice: Subject to any disclaimer, the term of this patent is extended or adjusted under 35 U.S.C. 154(b) by 0 days.

(21) Appl. No.: 11/904,848

(22) Filed: Sep. 28, 2007

(65) Prior Publication Data

US 2008/0127855 A1 Jun. 5, 2008

Related U.S. Application Data

(62) Division of application No. 11/502,917, filed on Aug. 11, 2006.

(51) Int. Cl.

| | |
|---|---|
| ***C03C 8/14*** | (2006.01) |
| ***C03C 8/16*** | (2006.01) |
| ***C03C 8/20*** | (2006.01) |
| ***C09D 1/02*** | (2006.01) |
| ***C09D 1/04*** | (2006.01) |

(52) U.S. Cl. ..... 501/17; 501/18; 501/20; 106/600; 106/605; 106/634; 106/635

(58) Field of Classification Search ..... 106/600, 106/605, 634, 635; 501/17, 20, 18
See application file for complete search history.

(56) References Cited

U.S. PATENT DOCUMENTS

| | | | | |
|---|---|---|---|---|
| 2,768,904 | A | 10/1956 | Chester | |
| 4,250,215 | A | 2/1981 | Mayer | |
| 5,387,439 | A | 2/1995 | Roberts | |
| 5,518,535 | A * | 5/1996 | Boaz | 106/38.3 |
| 5,562,991 | A | 10/1996 | Tannenbaum | |
| 5,595,639 | A | 1/1997 | Sano et al. | |
| 5,698,026 | A * | 12/1997 | Boaz | 106/600 |
| 5,702,520 | A * | 12/1997 | Boaz | 106/600 |
| 5,938,834 | A * | 8/1999 | Boaz | 106/600 |
| 6,001,494 | A | 12/1999 | Kuchinski | |
| 6,126,737 | A * | 10/2000 | Mason | 106/600 |
| 6,176,919 | B1 * | 1/2001 | Mason | 106/600 |
| 6,506,314 | B1 | 1/2003 | Whitney | |
| 2003/0012962 | A1 | 1/2003 | Beyrle | |
| 2003/0072129 | A1 | 4/2003 | Kuwako | |
| 2003/0224214 | A1 | 12/2003 | Garito | |
| 2004/0044165 | A1 | 3/2004 | Barancyk et al. | |
| 2004/0198852 | A1 | 10/2004 | Lin | |
| 2005/0124505 | A1 | 6/2005 | Hajmrle | |
| 2005/0268946 | A1 | 12/2005 | Miles | |
| 2006/0102871 | A1 | 5/2006 | Wang | |

FOREIGN PATENT DOCUMENTS

| | | | |
|---|---|---|---|
| JP | 58088140 | A | 5/1983 |
| JP | 358088140 | A | 5/1983 |
| WO | WO0142374 | A1 * | 6/2001 |

OTHER PUBLICATIONS

Henk J.W. Van Den Haak, Dispersants, Kirk-Othmer Encyclopedia of Chemical Technology, Apr. 18, 2003, p. 672-697, vol. 8, John Wiley & Sons, USA.

Fluorad Flurochemical Surfactant (FC 171) Technical Information Sheet, Commercial Chemicals Division—3M Company, Apr. 1981.

* cited by examiner

*Primary Examiner*—Anthony J Green
(74) *Attorney, Agent, or Firm*—Ater Wynne LLP

(57) ABSTRACT

The invented compositions for metal cladding of components in demanding applications can include one or more of liquid and/or colloidal sodium, potassium and/or lithium silicate, clay and/or clays, a compound of hollow micro-spheres (e.g. naturally occurring and nearly ubiquitous perlite and/or a synthetic hollow micro-sphere equivalent) and/or alumina or one or more flexible or malleable or resiliently deformable, impact-resistant materials such as plastomers, elastomers and/or other plastic, rubber, plastic-like or rubber-like materials; a wetting agent consisting of one or more of water or water and ethanol for fast drying under proper safety and venting conditions; and one or more surfactants and/or dispersants.

13 Claims, 3 Drawing Sheets

CAST IRON & STEEL COMPONENT CLADDING

METAL CLADDING COMPOSITION

RELATED APPLICATIONS

This divisional application claims the benefit of priority to U.S. Non-Provisional application Ser. No. 11/502,917, filed on 11 Aug. 2006 and entitled METAL CLADDING COMPOSITION, ADDITIVE, METHOD AND SYSTEM, the contents of which are hereby incorporated herein in their entirety by this reference.

FIELD OF THE INVENTION

The invention relates generally to the field of metal cladding (cladding, coating, painting and/or other application to or protective covering of a metal substrate) chemistries, methods and systems. More particularly, the invention relates to metal cladding of components in applications requiring high withstand high temperature (thermal) capacity and/or corrosion (oxidation, acid, alkaline and salts), other chemical, physical (torsion, impact and abrasion) and/or electrical resistance such as automotive; mining; oil and gas drilling and extraction, refining, storage and distribution; a substitute for galvanized steel; pulp and paper manufacturing; electric power generation; pipelines; clean rooms; agriculture; food and/or beverage handling, transporting and storage; hydrogen containment and conveyance including its use in hydrogen-powered vehicles and fuel cells, etc.

BACKGROUND OF THE INVENTION

Porcelain and ceramic formulations to protect metal from heat and corrosion, and to provide electrical insulation have been around since the early 1900's. This form of protection was and is used in the so-called 'white goods' industry (stoves, refrigerators, ovens, tubs, sinks, etc.). The earliest known usages of such coatings were on ancient Egyptian jewelry.

Previous applications of these glass- and/or clay-based protective coverings have ranged from use in the previously mentioned white goods industry to certain chemical storage containers to certain types of food processing and/or cooking containers. One of the problems that occurs when applying these coverings is that there are small pin hole exposures and crevasses in the hard outer shell that allow permeation (penetration) of the outer shell by the outside influences of such corrosive elements as gases, moisture and alkaline or acidic liquids. This permeation problem particularly follows exposure of the metal substrate to any significant degree of thermal shock, which tends to expand any fractures or surface imperfections in the outer shell and to further expose the underlying metal substrate, thereby speeding corrosion processes. Corrosion, of course, adversely affects the metal substrate, weakening it, and can result in complete failure of the covered metal parts.

Some industries have tried to use certain bare metal alloys and coated metal alloy substrates to overcome harsh oxidation and corrosion problems. The problem with most metal alloys (and certainly with exotic metal alloys) is cost and the persistent problem of short-term life expectancy of the metal part under many operational conditions, regardless of the nature of the conventional coating used. (Steel companies may claim that use of their alloys extends the life expectancy of a part when exposed to heat, even up to 1200° F. However, such alloys (which cannot be acid-resistant) so-exposed are now particularly subject to corrosion under even normal operating conditions.)

Examples of the above mentioned problems and shortcomings abound. For instance, the oil drilling and extraction industry uses expensive alloys and hardened carbon steel pipes and parts in the field. But even these pipes and parts have very short life expectancies due to the particularly abrasive and sometimes corrosive effects of the pumped-in gases and slurries as well as the corrosive effects of the heat and acids which form naturally in the wells.

Oil and gas refineries have a similar problem, particularly with sulfuric acid corrosion. Remarkably, for the normal repair of corroded and weakened parts, the entire refinery is typically shut down for as much as thirty days or more.

The mining industry has similar problems with the wear and related parts used in mining processes. Caustic or acidic chemicals and/or abrasive particulate slurries are regularly used in this industry. All of these environs are quite destructive to the coatings and to the metal substrates themselves. Silicon-based epoxies and industrial coatings are currently used to protect these metal substrates, but these coatings are subject to very rapid wear and degradation. Thus, the metals must be re-coated frequently.

These problems and challenges also exist in pulp and paper manufacturing, electric power generation, etc.

In many industries and applications, ultraviolet (UV) rays also have a damaging effect on traditional protective coatings, causing them to deteriorate even more quickly.

Even in industries where harsh environments are not the norm corrosion can present major problems. For example, galvanized steel structures, sheets and parts are used extensively in agriculture such as in pipes, grain storage silos and other containments, livestock food and water troughs and conveyances, etc. Corrosion is a problem for two reasons—despite galvanizing. First, galvanizing offers better protection of the steel than paint or other industrial coatings, but it is still an essentially temporary zinc coating over the metal substrate that it is intended to protect. But second, and more importantly, as the galvanized coating corrodes, zinc—a known toxic heavy metal—leaches into animal foods and water supplies, into grains and other consumer foods and into the ground, groundwater and water supplies.

In the same way, as galvanized steel guardrails degrade and corrode, they also leach toxic zinc into the ground, groundwater and water supplies.

In recognition of these problems with zinc plating and/or galvanizing, many jurisdictions in the United States and Europe (Europe has banned zinc effective 2007) are actively considering serious restrictions or bans on the use of zinc. Certain jurisdictions already have enacted such serious restrictions or even outright bans on the use of zinc.

Some helpful prior art methods and systems for metal cladding are described in U.S. Pat. No. 6,518,209 B2 issued Feb. 11, 2003;U.S. Pat. No. 6,800,375 B1 issued Oct. 5, 2004 and U.S. Pat. No. 6,818,314 B1 issued Nov. 16, 2004 to Gary Wilson, all entitled CHEMICAL RESISTANT GLASS FUSING COMPOSITION AND PROCESS FOR METAL MOTOR VEHICLE AND BUILDING INDUSTRY ARTICLES. These patents focus on using a dry mix of frit and frit additives (e.g. boric acid, potassium hydroxide, dry-sodium silicates and optionally pigmentation for color) to fuse compounds to metal articles for better chemical, thermal, electrical and corrosion resistance.

Even in view of the above Wilson patent contributions, many of the problems described above persist and their solutions have remained elusive.

SUMMARY OF THE INVENTION

The invented method of cladding a metal component includes creating a frit mixture in a defined ratio; wetting the mixture by adding a wetting agent in a defined volume; agitating the wetted mixture; applying the agitated mixture to a metal component by one or more processes; de-wetting the metal component having the applied mixture by gradually heating the same to a temperature from approximately 250 degrees Fahrenheit (° F.) up to a high of approximately 450° F.; and, fusing the de-wetted metal component at a temperature of no more than 125% of a defined withstand temperature for the clad metal component. The invented compositions for use in cladding metal includes: a frit mixture in a defined ratio as indicated in the tables below and including, optionally, as additives and/or additional steps, depending upon the desired performance characteristics of the finished clad part, one or more of dry and/or liquid and/or colloidal sodium, potassium and/or lithium silicate, clay and/or clays, a compound of hollow micro-spheres (e.g. naturally occurring and nearly ubiquitous perlite and/or a synthetic hollow micro-sphere equivalent) and/or alumina or one or more flexible or malleable or resiliently deformable, impact-resistant materials such as plastomers, elastomers and/or other plastic, rubber, plastic-like or rubber-like materials; and, a wetting agent consisting of one or more of water, ethanol, or water and ethanol for fast drying under proper safety and venting conditions, and one or more surfactants and/or dispersants (dispersing agents). Preparation of parts to be clad involves the use of one or more degreasing baths, utilizing one or more surfactants, and/or media blast stations, utilizing sand and/or other media, all of which are commonly used and are not unique to this invention.

Application of the frit mixture being referred to herein utilizes one or more dip/spray/coat stations or tanks for containing a wetted frit mixture by which a metal substrate can be coated and/or one or more spray stations for spray application of a wetted frit mixture and/or one or more electrostatic spray stations for the application of a wetted frit mixture (the number a combination of which is dependent upon the desired performance characteristics of the finished clad parts) and an optional airless spray station for the application of a wetted mixture specifically formulated for added corrosion resistance and clad-component strength; one or more de-wetting stations including a plurality of first heating elements configured controllably to gradually heat a dipped and sprayed metal substrate up to a de-wetting temperature of from approximately 250° F. up to a high of approximately 450° F. and then to gradually cool the heated metal substrate down to an ambient temperature; and, a fusing station including a plurality of second heating elements configured controllably to gradually heat a de-wetted metal substrate up to a cladding temperature of from approximately 1350° F. up to a high of approximately 1450° F. and then to gradually cool the clad metal substrate down to an ambient temperature. An optional powder clad application method is included in the embodiment of the invention which method eliminates the de-wetting station(s). The totality of the invented compositions, processes, methods and system may be from time to time herein referred to as the invented Fused Armor™ cladding system or, more simply, the invented system.

Fused Armor™ is a trademark owned by Applied Technology Laboratories, LLC, the assignee of the invention. Worldwide trademark rights are reserved.

DETAILED DESCRIPTION OF THE PREFERRED EMBODIMENTS

Figure 1:
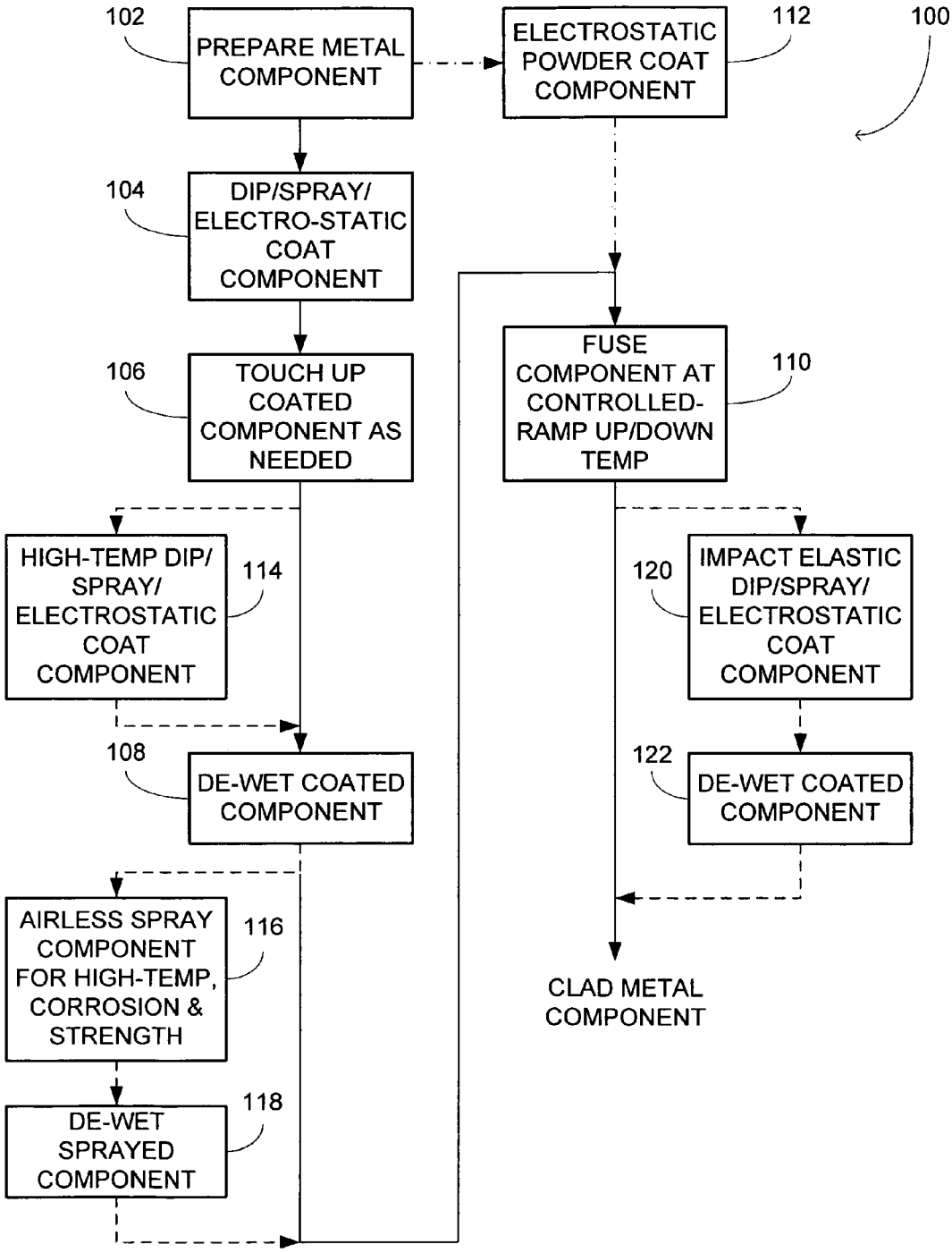
FIG. 1 is a flowchart illustrating the invented method in accordance with one embodiment of the invention.

The invention in accordance with a preferred embodiment involves compositions, processes, methods and a system for cladding a metal component—the invented Fused Armor™ cladding system.

The invented compositions represent a significant improvement over conventional compositions or mixes, even those described in the above-referenced patents. Under those prior art patents, including the Wilson patents referenced above, the fusing process involves heating a metal component having a frit mixture applied thereto at a temperature well above the intended withstand temperature of the clad metal component. This above referenced process is performed at a temperature between approximately 130-150% of the withstand temperature, whereas the present invention renders possible significantly lower baking or fusing temperatures and, therefore, lower cycle times (no more than 125% of the intended withstand temperature). Moreover, the invented system increases metal strength, reduces metal fatigue and gives metal substrates a higher tolerance for heat. This is accomplished via the unique outer shell which functions to keep the metal substrate under a constant state of compression thereby both strengthening it and reducing expansion and contraction. Furthermore, the invented Fused Armor™ cladding system provides a variety of other performance characteristics and combinations of performance characteristics that go significantly beyond the performance characteristics of conventional compositions or mixes and processes, even those described in the above referenced Wilson patents.

First, those of skill in the art will appreciate that applicant uses the coined "clad" or "cladding" terms herein broadly to refer to any protective covering, coating, painting or other application of the broadly defined compositions and additives to an inner or outer exposed surface of a metal substrate or component. Thus, cladding is not intended as a process or product limitation, but as being suggestive of the increased hardness and security (a la the battle armor cladding and protection of a soldier of yore) provided by the invented cladding compositions, by way of the invented system.

The invented base coat or cladding includes a frit, as is conventional, although a number of the frit ingredients and percentage contributions are novel. The various frit compositions that are believed to be most useful are tabulated below in Table IA, IB, IC and ID, which, it will be appreciated by those of skill in the art, are separated by end-use application (withstand temperature) and base material (metal substrate). It will be appreciated that withstand temperature is only one of the performance characteristics of the invented system and that its use in Tables 1A, 1B, 1C and 1D is for ease of presentation of formulations.

TABLE IA

| FRIT INGREDIENTS AND RATIOS | | | |
|---|---|---|---|
| WITHSTAND TEMPERATURE | SUBSTRATE MATERIAL | COMPOUND | % BY VOLUME |
| Up to 1250° F. | Cast iron | | |
| | | Borax | 3-47 |
| | | Feldspar | 2-38 |
| | | Quartz | 3-17 |
| | | Sodium nitrate | 4-8 |
| | | Barium carbonate | 6-7 |
| | | Cryolite | 0-2 |
| | | Zinc oxide | 1-16 |
| | | Fluor-spar (aka fluorite) | 4-10 |
| | | Cobalt oxide | 1-3 |
| | | Clay | 2-20 |
| | | Copper oxide | 0-3 |
| | | Dry sodium silicate | 2-5 |

TABLE IB

| FRIT INGREDIENTS AND RATIOS | | | |
|---|---|---|---|
| WITHSTAND TEMPERATURE | SUBSTRATE MATERIAL | COMPOUND | % BY VOLUME |
| Up to 1250° F. | Low Carbon Steel | | |
| | | Borax | 1-29 |
| | | Quartz | 3-46 |
| | | Soda ash | 5-15 |
| | | Sodium nitrate | 4-8 |
| | | Barium carbonate | 1-6 |
| | | Titania | 5-13 |
| | | Potassium Nitrate | 4-8 |
| | | Cryolite | 0-1 |
| | | Zinc oxide | 3-8 |
| | | Sodium Pyrophosphate | 2-8 |
| | | Clay | 1-15 |
| | | Copper oxide | 0-5 |
| | | Boric acid | 2-5 |
| | | Iron oxide | 1-8 |
| | | Feldspar | 10-40 |

TABLE IC

| FRIT INGREDIENTS AND RATIOS | | | |
|---|---|---|---|
| WITHSTAND TEMPERATURE | SUBSTRATE MATERIAL | COMPOUND | % BY VOLUME |
| 1250-1650° F. | Low carbon steel | | |
| | | Borax | 3-36 |
| | | Feldspar | 1-20 |
| | | Quartz | 3-17 |
| | | Boric acid | 1-15 |
| | | Nickel oxide | 0-6 |
| | | Potassium oxide | 3-6 |
| | | Alumina | 15-40 |
| | | Cryolite | 0-2 |
| | | Calcium oxide | 3-12 |
| | | Clay | 5-20 |
| | | Copper oxide | 0-5 |
| | | Boric acid | 0-4 |
| | | Dry sodium Silicate | 2-5 |

TABLE ID

| FRIT INGREDIENTS AND RATIOS | | | |
|---|---|---|---|
| WITHSTAND TEMPERATURE | SUBSTRATE MATERIAL | COMPOUND | % BY VOLUME |
| 1250-1650° F. | Stainless steel | | |
| | | Borax | 3-38 |
| | | Feldspar | 1-15 |
| | | Quartz | 3-46 |
| | | Boric acid | 4-9 |
| | | Nickel oxide | 0-23 |
| | | Zinc oxide | 2-3 |
| | | Titania | 5-13 |
| | | Potassium Nitrate | 1-4 |
| | | Alumina | 5-40 |
| | | Calcium oxide | 2-7 |
| | | Clay | 2-20 |
| | | Copper oxide | 0-5 |
| | | Dry sodium silicate | 2-5 |
| | | Flint | 10-30 |
| | | Iron oxide | 1-8 |

Those of skill in the art will appreciate that the above frit mixtures provide a base coat or cladding mixture for the present invention, which provides novel metal cladding compositions, optional additives, processes, methods and a system. The invented additives to the frit mixtures that render the invented compositions capable of many significant advantages over conventional metal coatings will be summarized in table form below. The examples, tables and various descriptions are meant to be illustrative only and are not to be construed as exhaustive or all-inclusive.

With regard to fusing temperatures versus withstand temperatures, if a clad metal component intended for a high-temperature automotive application, e.g. an automotive exhaust manifold, must operate reliably at approximately 1250° 1500°-1650° F., then using the system described in the above-referenced Wilson patents or other conventional methods, the metal component with the applied composition would have to be fused in an approximately 1600° 1950°-2250° F. environment. In accordance with the present invention, however, the clad metal component for use in an exhaust manifold of the above example requires fusing at a temperature of only approximately 1,350°-1,450° F. This is a significant result due to the markedly higher thermal operating capacity of the clad metal under the invented system. The clad metal is essentially a new material. An optional additive and process of the invented system also seals any possible remaining pin holes and fractures or fissures in the outer shell, making the outer shell impervious to moisture, chemical, and corrosive environments and, at the same time, improving electrical and abrasion resistance and greatly increasing thermal or heat resistance. Other surprising thermal characteristics of the invented system include virtually no peeling and/or flaking, under even extreme temperatures, and a steeper downward temperature gradient or roll-off in the area surrounding a hot clad metal component.

The invented system can extend the life of many components by a factor of two to five or more.

For example, in the automotive industry both heat resistance and corrosion resistance are critical issues for a variety of components. Not only must numerous parts be resistant to corrosion from moisture and road salt or airborne salts, but in the cases of brake and exhaust components, must also demonstrate high thermal capacities. The high temperature iterations of the invented compositions address many of these considerations and can extend the life of clad components by a factor of between two to five times, or more. In some tests, the life of certain metals has been extended to well over five times. Further, with today's leaner, hotter burning engines, and with the close proximity of many components, insulation also has become a key consideration. For such considerations, the invented compositions include a formulation that specifically addresses such insulation requirements while, at the same time, continuing to provide superior corrosion and heat resistance.

In another example, in this case with regard to acid resistance, heat exchangers in oil refineries have typically used stainless steel tubing and these components typically have a five-year life. In applications replacing the stainless steel tubing with low carbon steel tubing protected by an iteration of the invented cladding, operating life has been extended to twelve years (and still counting). Indeed, in many applications using the invented system with considerably less expensive low-carbon cold-rolled steel, the clad components outlast stainless steels in various corrosive (acid, alkaline and/or salt) environments by a factor of two to five times (or more).

In other applications, hardness and resistance to abrasion are the predominant considerations. The extreme hardness and abrasion resistance of certain formulations of clad materials, through the addition of certain silicates and/or clays, present significant improvements over conventional metals for numerous wear parts in such industries as mining and oil and gas drilling and extraction. Here, as well, the life of certain metal components, through the use of the invented system, can be extended by a factor of two to five times (or better). In many cases in such industries, corrosive environments are a secondary consideration for part life. Components clad with the invented system, as indicated above, demonstrate superior corrosion resistance as well. In addition, several invented cladding compositions are well suited to serve as hydrogen barriers for existing and future requirements. The invented cladding systems will maintain a consistent barrier to hydrogen, effectively eliminating penetration of a metal inner wall or pipe (again, extending the life expectancy of such parts or containment vessels by at least a factor of two to five). Hydrogen probably represents the greatest challenge for effective and safe containment and conveyance, but the usefulness of the invented system is equally effective and safe for numerous other problematic liquids and gases. Further, it is believed that, due to its refractory properties, the invented system will also be shown to be capable of markedly improving the effectiveness and safety surrounding the containment of atomic reactions and of radioactive waste.

Those of skill in the art will appreciate that the development of the cladding formulation of the present invention improves the performance of the metal substrate core of a clad metal part by strengthening the metal part itself. This is because the cladding places the metal substrate under a constant state of compression. The result is the reduction of metal fatigue and brittleness. On the other end of the scale from the formulations providing for increased hardness, is an iteration of the invented system, through the addition of certain plastomers, elastomers and/or plastics and/or rubbers or plastic-like and/or rubber-like materials, which adds impact shock absorption capacity to the clad surface. Such surfaces are not as abrasion-resistant or heat-resistant as other formulations, nor are they intended to be. Their function is to provide superior rock chip and other sharp impact resistance to certain clad surfaces so subjected such as automotive wheels.

The invention optionally provides for a very significant increase in the hardness and abrasion resistance of the hard outer shell itself versus traditional industrial coatings, plating or other protective coverings including galvanizing, as well as the above-referenced Wilson patents. As with the invented base compositions, this invention option also yields significant increases in the heat, chemical, corrosion, and electrical tolerance or resistance of the cladding material. It does so through the use of a combination of water-based sodium, potassium and/or lithium silicates and/or added clay or clays. This optional coat or cladding layer fills voids in the already hard outer shell rendering it even tougher.

Achieving good electrical insulation for cold-rolled low carbon steel or stainless steel metal parts has been elusive. Other coatings are either subject to fissures and breaches that can create shorts or such coatings are electrically conductive themselves. The invented claddings have sufficient silicates (glass) to provide excellent electrical insulation of the metal substrate from surrounding electrical sources. At the same time, the insulation characteristics of the invented claddings, together with its refractory characteristic, mean that the underlying metal substrate so clad can be excellent conductors if contact points are left exposed. However, by adding particles of conductive metals to the frit mixture, the surface or outer shell can be made conductive. In fact, selected substrates and composition formulas can be adjusted to allow for differing electrical conductivity (and electrical charge orientation retention) between the substrate and the surface. This is an exceptionally flexible invented system.

The invented system also has implication for the atomic energy industry including use in reactors as well as containment and storage of radioactive waste. Due to a low sputtering yield, the invented cladding composition can be used in a fusion reactor. The energetic gas atoms in a plasma tend to strike the vacuum container surface and undesirable sputtering (or the knocking off of container atoms) occurs. The heavier metal atoms in such containment metals as stainless steel, molybdenum or vanadium constitute a potential mass of materials that will tend to cause cooling of the gas and undesirably slow or even prematurely terminate the fusion reaction. The relatively low atomic number of the primarily glass formulation outer shell has a far less deleterious effect. Therefore, the sputtering yield of the invented compositions, i.e. the number of atoms knocked off the containment wall is much lower than that of currently used containment metals. It is believed that clad materials made in accordance with the invention lend themselves to use in nuclear fusion reactors. Likewise, storage of nuclear waste would contemplate cladding containment vessels, thereby turning such a vessel into a sealed, relatively impervious (and internally refractive) container. Again, the low atomic number of a primarily glass formulation shell is the advantage of using this material instead of a bare metal substrate or a conventionally coated metal substrate.

Hydrogen permeability is a very serious problem for virtually all metal substrates used for storage, transportation and distribution or delivery to its intended end use. Hydrogen permeates or diffuses quite rapidly into metals, causing them to degrade and become quite brittle, and leads to a very dangerous decrease in the fracture strength of these metal substrates. This has been a key factor in delaying the development of reliable hydrogen storage, transportation and delivery systems. The invented claddings, with their tough outer primarily glass formulation shells virtually eliminate hydrogen permeability to the metal substrate extending the life of the clad metal component by a factor of ten.

Finally, two very important advantages of the invented system over conventional coatings or even the above-referenced Wilson patents relate to improving environmental quality and preserving existing USA fossil fuel reserves.

Environmental quality is favorably impacted in two primary ways by the application of the invented system.

First, the superior performance characteristics for thermal shock resistance, resistance to thermal degradation, resistance to component oxidation and thermal insulation of the invented system allow for leaner, hotter burning internal combustion engines. This results in lowered emissions due to the attendant decreases in fuel usage. In addition, it is believed that when the invented cladding is applied to catalytic converters, the efficiencies of such catalytic converters are significantly improved. Preliminary testing has confirmed this belief. Further, preliminary testing has also indicated reductions in backpressure with catalytic converters so clad. This reduction in backpressure creates increases in engine performance that translate into additional reductions in fuel usage and, thus, into additional reductions in harmful emissions.

Second, use of the invented cladding as a substitute for galvanizing will also favorably impact water quality and food purity. When galvanized metals degrade, harmful amounts of zinc can be released into ground waters and the food supply chain. No zinc, or any other heavy metals, are present in any of the invented system formulations. Therefore, not only do the invented claddings far outlast galvanizing, but in applications ranging from highway guardrails to agricultural food supply chain containments and conveyances, this zinc problem can be eliminated.

Preservation of existing USA fossil fuel reserves can also be enhanced in several ways by the application of the invented system.

First, as mentioned above regarding environmental quality benefits, decreased fuel consumption can be achieved through the application of the invented system to the exhaust systems of internal combustion engines, thereby reducing demand for petroleum.

Second, one of the most problematic hindrances to widespread use of hydrogen as a fuel, both for stationary and mobile uses, has been its destructive permeability of the metal surfaces used in its storage, transportation and distribution. The invented system solves this problem by providing a virtually impenetrable barrier between such metal surfaces and the hydrogen, thereby opening the door for much wider use of hydrogen as a substitute for fossil fuel reserves.

Third, certain performance characteristics of the invented system lend themselves well to use in nuclear reactors and the containment of radioactive waste. Improved reactor efficiencies will indirectly enhance the attractiveness of atomic energy as a substitute for fossil fuel energy, but perhaps the most compelling use of the invented system is in regard to radioactive waste containment and storage. Certain formulations of the invented claddings can vastly improve the efficiency and permanence of such containment and storage. These improvements could greatly reduce the actual dangers of such, allay public fears concerning this subject and ease the increased usage of atomic energy as a viable substitute for the use dwindling fossil fuel resources.

A fourth possible area of preservation also exists. The invented system can improve the performance of various wear surfaces and parts used in mining coal, tar sands and oil shale and various parts and tools used in the oil and gas drilling and extraction industry. To the extent that these industries experience greater efficiencies through the use of the invented system, lessened waste may translate into greater preservation of existing fossil fuel reserves.

Below is a list of end user groups (industries) and some of the end uses (fields of use) for which the invented claddings particularly lend themselves. This list is meant to be illustrative only and to present an easy-to-review format. It is not by any implication meant to be exhaustive or all-inclusive.

1) Automotive: Primarily thermal and corrosion resistance and thermal insulation, but also impact resistance, metal strengthening and allowing for the substitution of lower cost metal substrates. Corrosion resistance in hydraulics. Also including virtual elimination of static electricity sparking and/or electrostatic discharge (ESD). Certain applications benefit from shock absorbing impact resistance. Eventual replacement for zinc body and frame coating.

2) Oil & Gas: Primarily abrasion resistance and increased metal strength (drilling and extraction) and corrosion (acid) resistance in refineries. Also including virtual elimination of static electricity sparking and/or ESD. And decreasing refinery down time for repairs by extending the life of the metal piping, storage tanks, thermal exchange units, etc.

3) Agriculture: Primarily corrosion resistance and replacement for zinc galvanizing wherever water and food supply chain contact points are present.

4) Mining & Quarrying (including metals, minerals, aggregates and tar sands & oil shale): Primarily protection of wear surfaces and extract and slurry conveyances, increased metal strength and other corrosion and abrasion resistance. Corrosion resistance in hydraulics. Also including virtual elimination of static electricity sparking and/or ESD.

5) Hydrogen (and other reactive gases & liquids) Containment, Transportation and Distribution to End Usage Points: Primarily corrosion and other reaction resistance.

6) Hazardous & Radioactive Materials Containment & Storage: Primarily metal strength and refractive characteristics of the cladding itself.

7) Chemical, Pulp & Paper, Plastics & Rubber and Textile Manufacturing: Primarily corrosion (primarily acid) resistance and protection of wear surfaces. Corrosion resistance in hydraulics.

8) Construction & Civil Engineering: Replacement for galvanizing (guardrails, corrugated panels, etc.), increased metal strength and electrical resistance (electrical junction boxes, etc.). Also including thermal protection and insulation in such applications as fire doors, fire-safe cabinets, fire walls, etc.

9) Utilities: Various—corrosion resistance and/or electrical insulation (electric power generation and distribution) and corrosion resistance (natural gas distribution and water & sewer systems). Also including virtual elimination of static electricity sparking and/or ESD in natural gas applications.

10) Food & Beverage Manufacturing, Transportation, Storage, Preparation & Service: Primarily use of the virtually impenetrable outer shell for ease of cleaning and preservation of sanitary surfaces.

11) Consumer & Industrial Electronic and Medical & Scientific Devices: Primarily electrical insulation and refractive characteristics for shielding various energy frequencies. It is also believed that certain formulations will exhibit characteristics for the storage and transmission of data, e.g. by maintaining higher light energy levels by reflection, refraction or other means.

12) Marine & Boating: Primarily corrosion and thermal resistance in engine and exhaust systems and for exposed surfaces, corrosion resistance in hydraulics, but also including the use of the virtually impenetrable outer shell for preservation of sanitary surfaces in food and water systems and the prevention of electrolysis in various applications. Also including virtual elimination of static electricity sparking and/or ESD.

13) Aviation: Primarily thermal and corrosion resistance in certain engine and exhaust applications, corrosion resistance in hydraulics, but also including the use of the virtually impenetrable outer shell for preservation of sanitary surfaces in food and water systems.

14) Military: Various but including thermal insulation for the reduction or elimination of vehicle exhaust heat signatures, corrosion resistance in hydraulics and the hardening of defensive and offensive surfaces.

15) Other: Eliminate corrosion and electrolysis problems on low carbon steel, cast iron, stainless steel and aluminum.

Those of skill in the art will appreciate that, due to the various metal substrates and the various desired performance characteristics, the additives to the composition are extremely variable and the percentages of those additives are equally variable. For example, the compositions and inherent characteristics of gray cast iron and malleable (ductile) cast iron are significantly different. Different steels likewise contain different compositions and have different characteristics. Even such steel sub-categories as stainless steel contain a very wide variety of compositions and have differing characteristics. Added to these metal substrate differences are the variations in the desired performance characteristics of the finished clad items. In addition, certain variations are necessary due to the optional use of differing processes (dip, spray, electrostatic and/or, optionally, powder cladding) for the application of wetted frit compositions. This is why there are such wide variances in the formulations indicated in the preceding Tables. Those of skill in the art will likewise therefore appreciate that the additives used in the invented system also have such variations. For example, embodiments of the composition can include a high-molecular-weight dispersing agent in a volume ratio within the range of approximately 0.25-0.75 ounce per gallon. A 'high molecular weight' dispersant is generally regarded by those having skill in the dispersant arts as one having a molecular weight of 1000 or greater. In an embodiment, a dispersing agent is formulated with a wetting composition (a composition including a wetting agent) substantially to suspend therein a frit mixture and one or more silicates.

Table II below summarizes the additives that form a part of the present invention:

TABLE II

| ADDITIVES TO FRIT MIXTURE AND/OR SECOND COATINGS | |
|---|---|
| COMPOUND | % BY VOLUME (DEFAULT) OR WEIGHT OR VOLUME/ MASS RATIO |
| Colloidal Silicates | 0-20 |
| Liquid Sodium Silicate | 0-20 |
| Liquid Potassium Silicate | 0-20 |
| Liquid Lithium Silicate | 0-20 |
| Iron oxide | 1-5 |
| Hollow Micro-Spheres and/ or Other Materials Capable of Creating Micro-Voids | 0-10 |
| Wetting agent of water or, for certain applications, water and ethanol* | 1 gallon/1-4 pounds dry mix |
| Surfactants | 0.25-4 |
| Dispersants | 0.25-0.75 ounce/1 gallon |
| Plastomers, Elastomers and/or Plastic or Plastic-like Rubber or Rubber-like Materials | 5 (by weight) |

TABLE II-continued

| ADDITIVES TO FRIT MIXTURE AND/OR SECOND COATINGS | |
|---|---|
| COMPOUND | % BY VOLUME (DEFAULT) OR WEIGHT OR VOLUME/ MASS RATIO |
| Particulates of titanium, flint, quartz, and/or diamond, etc. | 0-5 |
| Pigment† | 0-1.5 |

*For fast drying under proper safety and venting conditions.
†Color additives (pigments) utilize non-toxic metal oxides.

The clad metal part production line preferably includes a conveyer system where the parts are run uniformly through one or more dip/spray/electrostatic coat stations, and/or one or more spray stations, and/or one or more electrostatic spray stations and/or optional airless spray stations to apply the one or more wet coats; one or more de-wetting stations including a plurality of first heating elements configured controllably gradually to heat a dipped and sprayed metal substrate up to a de-wetting temperature of from approximately 250° F. up to a high of approximately 450° F. and then to gradually cool the heated metal substrate down to an ambient temperature; and, a fusing station including a plurality of second heating elements configured controllably to gradually heat a de-wetted metal substrate up to a cladding temperature of from approximately 1350° F. up to a high of approximately 1450° F. and then gradually to cool the clad metal substrate down to an ambient temperature. An optional powder clad application method is included in the embodiment of the invention which method eliminates the de-wetting station(s).

The basic cladding sequence, with indicated options, for metal clad component production in accordance with the invention proceeds as follows, by reference collectively to FIGS. 1 and 2. Those of skill in the art will appreciate that, with respect to the control lines illustrated in FIGS. 1 and 2, solid lines indicate the basic process or sequence, dash-dot lines indicate a powder coat alternative process or sequence and cashed lines indicate high-temperature and impact-resistant steps that are optional to the basic process or sequence.

Figure 2:
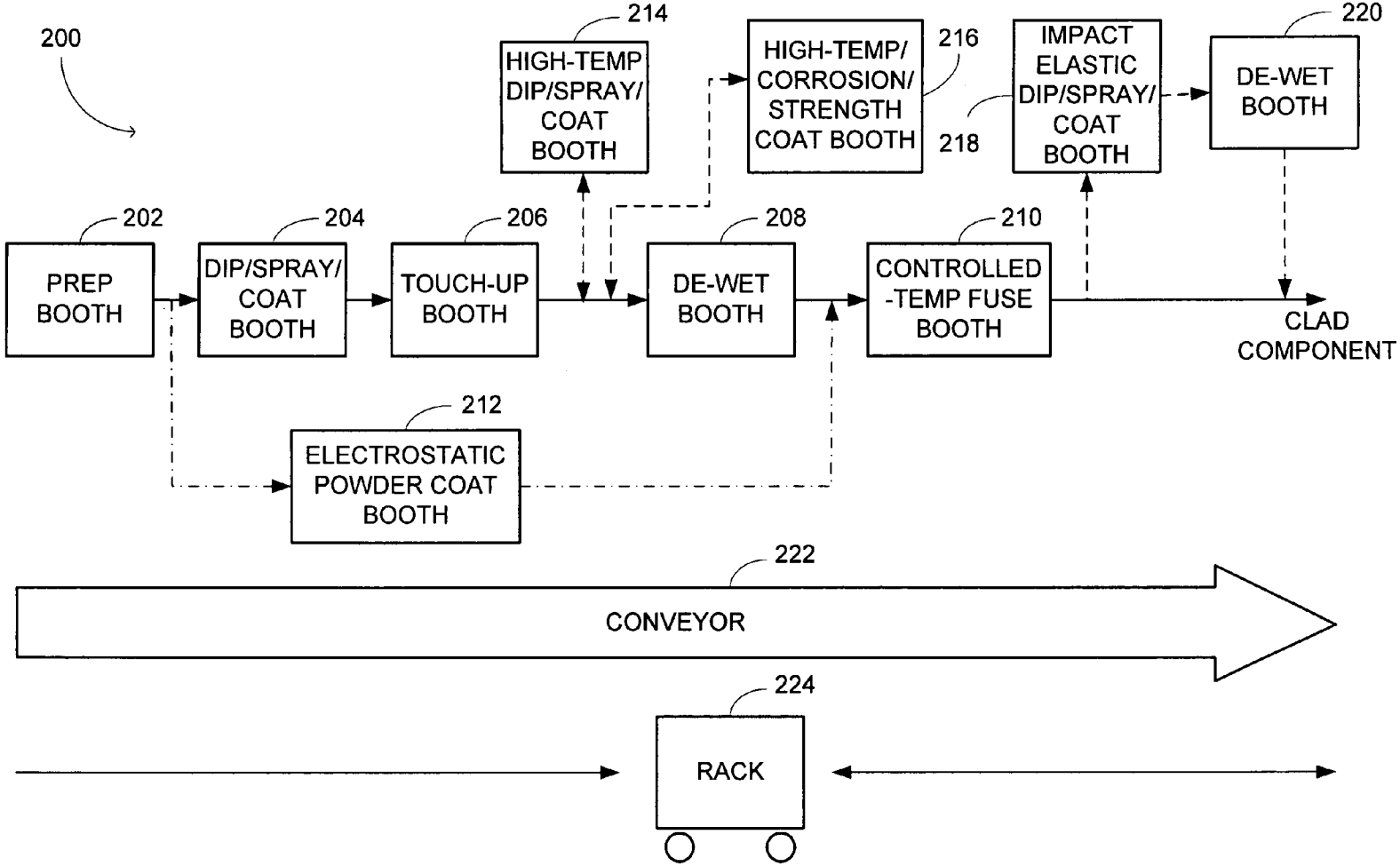
FIG. 2 is a system block diagram illustrating the invented system in accordance with one embodiment of the invention.

1) After conventional component preparation (degreasing and/or surface preparation, as by water and/or surfactant bath, media blast, rinse, air dry, etc., FIG. 1, block 102; FIG. 2, block 202), the basic sequence begins with the first application of the wetted cladding composition to the part (FIG. 1, block 104; FIG. 2, block 204).

a. If the powder cladding option is used, the sequence begins with the first (and only) application of the powder cladding composition to the component (FIG. 1, block 112; FIG. 2, block 212).

b. Under this option, the component is not de-wetted and does not return to the basic sequence until just before the fusing stage.

2) The basic sequence continues to touch up, as needed (FIG. 1, block 106; FIG. 2, block 206).

a. If the high temperature insulation cladding option is used, the sequence continues to the application of a high temperature insulation composition (FIG. 1, block 114; FIG. 2, block 214).

b. The component then returns to the basic sequence.

3) The basic sequence continues to the primary de-wetting station (250-450° F., FIG. 1, block 108; FIG. 2, block 208). The component must be brought up to the de-wetting temperature gradually and cooled down to room temperature gradually (see FIG. 3, discussed below).

a. If the high temperature plus added strength- and corrosion-resistance option is used, the sequence continues to the application of a high temperature plus added strength and corrosion resistance composition (FIG. 1, block 116; FIG. 2, block 216)

b. The optional sequence then continues to a secondary de-wetting station that can be the same as the primary de-wetting station or different, depending upon floor plan, 250-450° F., FIG. 1, block 118; FIG. 2, block 208)

c. The component then returns to the basic sequence.

4) The basic sequence (and any prior options, if used) continues to the fusing station (1350-1450° F., FIG. 1, block 110; FIG. 2, block 210). The part must be brought up to the fusing temperature gradually and cooled down to room temperature gradually (see FIG. 3, discussed below).

a. If the shock-absorbing impact resistance option is used, the sequence continues to the application of a shock-absorbing impact resistance composition (FIG. 1, blocks 120, 122; FIG. 2, blocks 218, 220). Those of skill in the art will appreciate that 4)a. is a lower temperature composition and would not be combined with either of the high temperature options. It could, however, be combined with the powder cladding option.

b. The optional sequence then continues to a secondary de-wetting station (250-450° F., FIG. 1, block 122; FIG. 2, block 220). Those of skill in the art will appreciate that de-wetting station or booth 220 can be the same as the primary or secondary de-wetting station or booth represented in FIG. 1 by block 108, 118 and in FIG. 2 by block 208.

c. The component then returns to the basic sequence.

5) The component cladding process in accordance with the invention is finished.

Those of skill in the art will appreciate that a conveyor 222 and/or wheeled rack 224 can be used in accordance with the invention to move the component from one station or booth to another and back, as needed. Those of skill in the art also will appreciate that metal components clad in accordance with the invention exhibit remarkable insulative, or temperature withstand, capacities. A clad cast iron component made in accordance with the basic sequence can withstand 1250° F. and in accordance with the high-temp process can withstand more than 1650° F., contrasted with 1000° F. for an unclad cast iron component. A clad cold rolled steel component made in accordance with the basic sequence can withstand 1250° F. and in accordance with the high-temp process can withstand more than 1650° F., contrasted with 1000° F. for an unclad cold rolled steel component. A clad stainless steel component made in accordance with the basic sequence can withstand 1250° F. and in accordance with the high-temp process can withstand more than 1650° F., contrasted with 1200-1250° F. for an unclad stainless steel component.

Figure 3:
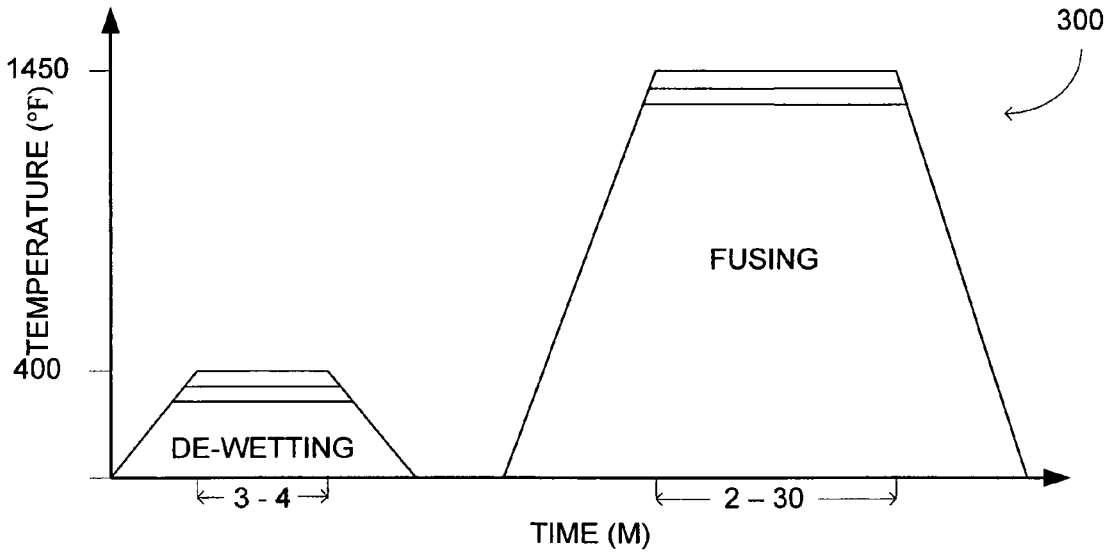
FIG. 3 is a temperature (vertical axis labeled TEMPERATURE) v. time (horizontal axis labeled TIME) graph of the de-wetting and fusing steps that form a part of one embodiment of the invented method and system.

FIG. 3 illustrates a time v. temperature graph of two of the process steps in accordance with the invention, in which controlled temperature ramp-up, hold and ramp-down steps are illustrated for the de-wetting and fusing of clad metal components. The graph illustrates the temperatures to which the metal components are elevated, rather than the above-temperature withstand capacities of the clad metal components. It will be appreciated that alternative ramp-up, hold and ramp-down times and shapes (e.g. lines, curves, steps, etc.), as well as temperature ranges, are contemplated as being within the sprit and scope of the invention.

Those of skill in the art will appreciate that process steps can be re-ordered or modified, and that system stations, booths or other parts can be re-arranged or modified, as is contemplated by the invention. Thus, the description and drawings are seen to illustrate but not to limit the invention, the scope of which is defined by the appended claims.

It will be understood that the present invention is not limited to the method or detail of construction, fabrication, material, application or use described and illustrated herein. Indeed, any suitable variation of fabrication, use, or application is contemplated as an alternative embodiment, and thus is within the spirit and scope, of the invention.

The present invention provides many advantages over the prior art cladding additives, compositions, components, methods and systems. Many of these advantages relate to the greatly improved clad metal characteristics.

Achieving extended heat resistance of up to 40% thus also significantly lowers production costs (curing for use at 1750°-1850° F. requires curing at 2000°-2100° F., or only approximately 300°-350° F. or 25% above the expected range of use versus convention). For example, in an exhaust manifold intended to withstand temperatures up to 1650° F., the conventional method calls for 1950-2,050° F. curing temperature, far above the 1450° F. temperature in accordance with the invention. The addition of the silicates increases the withstand temperature or thermal capacity to up to 1900° F. Chemical resistance is improved by approximately 30-35% due to the addition of the liquid silicates. When silicate films are completely dehydrated, they provide excellent resistance to acid and high temperature, i.e. they are great thermal insulators. Most silicates used for coatings or binders have softening points of approximately 1200° F. and flow points of 1500°-1600° F. Resistance to higher temperatures can be achieved by adding clay to the formulation. Depending on the aluminum or magnesium content of the clay, the silicates can service temperatures up to approximately 3200°-3400° F. with the addition of clay, depending upon the aluminum or magnesium content. This is believed to be due to the formation of a ceramic bond. Mixtures of copper, nickel chromium and stainless steel powders to the silicate vehicle provide a high temperature-resistant coating for metals.

Improved bonding strength is achieved in accordance with the invention by allowing for flexibility of use with various metal substrates and allowing for more flexibility of ingredients (metals and other glass/ceramics). The sodium and potassium silicates in aqueous solutions have physical and chemical properties that are useful in bonding and cladding applications. When applied as a thin layer on or between surface coats of other materials, the silicate solution dries to form a tough tightly adhering inorganic bond or film that exhibits the following characteristics:

1) Non-flammable;

2) Resistant to temperatures up to approximately 3000° F. or higher;

3) Odorless and non-toxic;

4) Moisture resistant;

5) Bondable to metals, particles (e.g. refractory materials, glass, ceramics);

6) Improves strength and rigidity of the metal;

7) Can be used as a binder for ceramics or powdered metals for high-temperature coating applications and welding rod coatings;

8) Liquid sodium and potassium silicates also can be reacted with a variety of acidic or heavy metal compounds to produce solid, insoluble bonds or films; and 9) Multivalent metal compounds react with the silicate solutions to form coatings or bonds by precipitation of insoluble metal silicate compounds.

Surface flexibility can be achieved to a moderate degree by the addition of synthetic plastics and/or natural or synthetic rubbers to the silicate solution. Typically, 1-6% by weight of sugar, glycerine or other polyhydric alcohols is used. Up to 30% of sorbitol (aka glucitol) can be used, provided the silicate solution is diluted to avoid excessive thickening. Natural or synthetic rubber lattices can also be employed. Incorporation of finely ground clays and other cladding materials in the dry or wet process applications also produces a chip-resistant flexible outer film protecting the hard and relatively brittle outer shell of the claddings.

The liquid sodium silicates are solutions of glasses which are made by fusing varying proportions of sand and soda ash. These proportions are usually defined in accordance with a specific product SiO2O weight ratio. A liquid potassium silicate similarly is defined in accordance with several SiO2/K2O weight ratios. The potassium silicates are similar to the sodium silicates but have properties that are better suited for some applications, e.g. when greater electrical resistance is required.

Depending upon the composition of the cladding, the hardness is at least approximately 5-7 Mohs or greater on the mineral hardness scale, especially if flint, diamond dust and/or zeolite are added to the formulation or pencil hardness scratch tests commonly used to evaluate organic finishes indicate comparable values on the Knoop hardness scale of at least approximately 350-660 HK. The clad metal substrates outperform any unprotected metal substrate by a factor of at least approximately five in terms of longevity and reliability of the clad and its metal core. This is due to its resistance to gouging or crushing of the underlying hard fused shell and its high surface hardness (surface abrasion resistance, high gloss and good lubricity). By adding surfactants to increase the strength of the glass outer shell, the abrasion resistance is increased by a factor of at least approximately two. Thus, the hardness of the glass outer shell is at least approximately 3.5-6 Mohs and comparable values on the Knoop hardness scale of at least approximately 149-560 HK. In an embodiment, the surfactant has a pH of approximately 8 or higher. In another embodiment, the surfactant is an anionic surfactant. In still another embodiment, the surfactant is sodium ethylhexyl sulfate.

In general, the clad material protecting the metal substrate will not crush at a point of impact because the cladding's compressive strength is at least approximately 20,000 pounds per square inch (psi). Thus, the fused cladding does not typically fail unless the metal substrate permanently deforms. Moreover, the metal substrate itself is strengthened by the clad material due to the latter's low ductility and fused bond with the metal substrate. Thus, there is a kind of stiffening effect on the entire metal component. Those of skill in the art will appreciate that the stiffening effect is more pronounced on lighter gauges of metal than on heavier ones. By adding more mils of clad—in accordance with the invention as by double coating or spraying or as by more prolonged coating or spraying or as by more coating or spraying with a more viscous composition or additive—stiffness, wear resistance, chemical resistance and electrical resistance can be increased. By adding surfactants to the formulation, in accordance with the invention, a thicker overall coating is obviated while strength is uncompromised and permeability is diminished, e.g. by sealing otherwise exposed bubbles and pin holes underneath the hard outer shell. This produces a cost savings in time and money also, since the heating of the cure ovens is reduced in time and temperature. Moreover, a thinner coating, e.g. 5-6 mils in thickness, produces added surface flexure, which is useful in certain applications.

Silicate coatings and adhesives are inorganic aqueous polymers in terms of their surface characteristics. They perform most effectively on hydrophilic, non-oily surfaces, where they achieve proper wetting and hence maximum adhesion. Generally, a thin contiguous silicate film between the surfaces of the clad materials provides the added optimum adhesion needed to tie or bind the two coatings together in an impervious bond. Bonding strength can be improved by adding the silicates to alcohol to produce a mixture of ethyl silicate. Improved bonding strength in the clad outer shell is attained in accordance with the invention by using the mixtures of monosodium phosphate and silica when used with the finely divided, high-temperature refractory proven additives of olivine, zircon, zirconia, alumina and/or diamond dust. Glossy finishes are needed for high lubricity applications such as air flow, liquid flow, thick substances, bulk materials, etc. In contrast, when a non-skid surface nevertheless requires some friction, a matte finish is needed. Both are possible with the invented cladding composition, additive, process, method and system (wherein a composition configured to provide a glossy finish can be considered a 'gloss mixture', and a composition configured to provide a matte finish can be considered a 'matte mixture'.

Addition of hollow micro-sphere materials such as perlite or a structural equivalent (e.g. hollow high-temperature-rated glass beads) to the claddings in the second coat increases the insulation capabilities of the clad metal parts. Air is a well-known insulator and glass is a well-known conductor of heat. The combination of both characteristics in the protective hard shell of, for example, an internal combustion engine's exhaust manifold, causes heat on the inside of the clad metal to 'refract' the heat inwardly of the hot wall and also to trap the heat within the internal air pockets on the outer surface of the cold wall. As a result, ambient temperatures can be recorded a mere inch away from surface outer skin metal temperatures as high as 600°-800° F. Thus, heat shielding of pipelines, for example, where heat is needed to move otherwise viscous liquids, is contemplated by the invention.

Chemical corrosion and oxidation resistance is important to so-called 'weathering', or the quality of retaining the original gloss and color of a clad metal surface. Clad metal substrates made in accordance with the invention have been tested as passing a simulated 24-year weathering test for cast iron, cold rolled steel and 409 stainless steel with only a 3-10% rust factor, which represents an improvement of nearly 2:1 over the white-goods industry's porcelain standard. The cladding material of the present invention is extremely protective against acid and alkali environments, e.g. salts, liquids, gases, etc. Thus, performance of the clad metal components in the face of soil corrosion, organic solvent corrosion, general chemical corrosion and acid corrosion influences is reliably high. It is believed that negative influences are kept at bay by the impervious outer shell produced by use of surfactants in the final cladding coat.

The inert, impermeable qualities of the clad hard glass outer shell render it a superior electrical insulator. Thus, if conduction is desired, using steel as a base metal, some selected areas of the metal are intentionally left uncoated for the purpose of making electrical connections. Electrical resistance per unit area is a function of the composition of the cladding including the use of nano-particles of silica in the hard outer shell. Thus, electrical resistance and electrical conductance are controllable. Electrical properties in general can be greatly improved because sodium and potassium silicates exhibit good dielectric properties when dehydrated. Indeed, completely dehydrated sodium and potassium silicates exhibit a specific resistance of approximately $3\times10^{10}$ ohm-centimeters—about the same as common plate glass. Electrical resistance is lower when more alkaline sodium silicates are used. Potassium silicates, when fully dehydrated, exhibit greater electrical resistance than sodium silicate. Thus, in accordance with one embodiment of the invention, maximum resistance is obtained by combining selected proportions of potassium and sodium silicates. The resulting claddings made in accordance with the teachings herein improve electrical resistance in transformer cores, conducting films and insulating materials (electrical insulators, anti-shock safety equipment, etc.).

Dielectric strengths of at least approximately 450-680 volts per mil of cladding thickness are achieved. It is believed this is due to the sealing against surface variations and of the internal bubble structure and pin holes using nano-scale silicates (e.g. potassium, lithium and sodium) that create denser and thus more conductive surfaces. Testing such clad metals made in accordance with the invention with up to approximately 4000 volts produces no spark whatsoever. Thus, the dielectric strength of the invented clad metals in accordance with the present invention represents nearly a factor-of-two improvement over the dielectric strength even of the impressive clad metals disclosed in the above-referenced Wilson patents.

Thus, the invention produces clad metal components having higher physical, chemical and electrical resistance than prior art components. The invention also produces clad metal components having higher impact resistance, corrosion resistance and smoothness in the outer surface. As such, the clad metal components made in accordance with the present invention exhibit longer life, greater durability and higher reliability than prior art clad metal components. Moreover, because the cladding compounds made in accordance with the present invention are primarily of glass, which is organic, they produce no toxic or otherwise harmful waste when used or recycled, in a net positive environmental benefit.

It is further intended that any other embodiments of the present invention that result from any changes in application or method of use or operation, method of manufacture, shape, size, or material which are not specified within the detailed written description or illustrations contained herein yet are considered apparent or obvious to one skilled in the art are within the scope of the present invention.

Accordingly, while the present invention has been shown and described with reference to the foregoing embodiments of the invented apparatus, it will be apparent to those skilled in the art that other changes in form and detail may be made therein without departing from the spirit and scope of the invention as defined in the appended claims.

It will be understood that the present invention is not limited to the method or detail of construction, fabrication, material, application or use described and illustrated herein. Indeed, any suitable variation of fabrication, use, or application is contemplated as an alternative embodiment, and thus is within the spirit and scope, of the invention.

It is further intended that any other embodiments of the present invention that result from any changes in application or method of use or operation, configuration, method of manufacture, shape, size, or material, which are not specified within the detailed written description or illustrations contained herein yet would be understood by one skilled in the art, are within the scope of the present invention.

Finally, those of skill in the art will appreciate that the invented method, system and apparatus described and illustrated herein may be implemented in software, firmware or hardware, or any suitable combination thereof. Preferably, the method system and apparatus are implemented in a combination of the three, for purposes of low cost and flexibility. Thus, those of skill in the art will appreciate that embodiments of the methods and system of the invention may be implemented by a computer or microprocessor process in which instructions are executed, the instructions being stored for execution on a computer-readable medium and being executed by any suitable instruction processor.

Accordingly, while the present invention has been shown and described with reference to the foregoing embodiments of the invented apparatus, it will be apparent to those skilled in the art that other changes in form and detail may be made therein without departing from the spirit and scope of the invention as defined in the appended claims.

I claim:

1. A composition for use in cladding metal, the composition comprising:

a frit mixture;

a wetting agent selected from the group consisting of water, ethanol, and a mixture thereof;

a colloidal and/or liquid sodium silicate in the amount of approximately 1-20% by volume; and/or a colloidal and/or liquid potassium and/or lithium silicate in the amount of approximately 1-20% by volume;

an iron oxide in the amount of approximately 1-5% by volume; and a surfactant other than the wetting agent in the amount of approximately 0.5-1% by volume.

2. The composition of claim 1, wherein the surfactant has a pH of approximately 8 or higher.

3. The composition of claim 2, wherein the surfactant is an anionic surfactant.

4. The composition of claim 3, wherein the surfactant is a sodium ethylhexyl sulfate.

5. The composition of claim 1, further comprising:

a compound characterized by hollow micro-spheres in the amount of approximately 1-10% by volume.

6. The composition of claim 5, further comprising:

one or more materials selected from a group consisting of a high-molecular-weight dispersing agent, a pigment for color in an amount of approximately 1.5% by volume of the wetting agent, and an additive including one or more materials selected from a group consisting of particulate titanium, flint, quartz, and diamond.

7. The composition of claim 6, wherein the high-molecular-weight dispersing agent present within the composition in a volume ratio of approximately 0.25-0.75 ounce per gallon.

8. The composition of claim 1, wherein the frit mixture is one of a matte or gloss mixture selected from a group of frit mixtures consisting of:

a first mixture including at least two materials selected from the group consisting of borax, feldspar, quartz, sodium nitrate, barium carbonate, cryolite, zinc oxide, fluorspar, cobalt oxide, clay, copper oxide and dry sodium silicate;

a second mixture including at least two materials selected from the group consisting of borax, quartz, soda ash, sodium nitrate, barium carbonate, titania, potassium nitrate, cryolite, zinc oxide, sodium pyrophosphate, clay, copper oxide, boric acid, iron oxide and feldspar;

a third mixture including at least two materials selected from the group consisting of borax, feldspar, quartz, boric acid, nickel oxide, potassium oxide, alumina, cryolite, calcium oxide, clay, copper oxide and dry sodium silicate; and a fourth mixture including at least two materials selected from the group consisting of borax, feldspar, quartz, boric acid, nickel oxide, zinc oxide, titania, potassium nitrate, alumina, calcium oxide, clay, copper oxide, dry sodium silicate, flint and iron oxide.

9. A composition for use in cladding metal, the composition comprising:

a frit mixture;

a wetting agent selected from the group consisting of water, ethanol, and a mixture thereof;

a colloidal silicate in an amount of approximately 1-20% by volume; and a dispersant other than the wetting agent formulated with the composition substantially to suspend the frit mixture and one or more silicates therein;

a surfactant other than the wetting agent in the amount of approximately 0.5-1% by volume.

10. The composition of claim 9, wherein the dispersant is a high-molecular-weight dispersant.

11. The composition of claim 9, wherein the colloidal silicate includes one or more of a liquid sodium silicate and a liquid potassium silicate and a lithium silicate in a collective amount of approximately 1-20% by volume.

12. The composition of claim 9, further comprising:

one or more materials selected from a group consisting of an iron oxide in the amount of approximately 1-5% by volume, a surfactant in the amount of approximately 0.5-1% by volume, and a compound characterized by hollow micro-spheres in the amount of approximately 1-10% by volume.

13. The composition of claim 9, which further comprises:

one or more materials selected from a group consisting of a plastic and a natural or synthetic rubber.

* * * * *